US009079233B2

(12) United States Patent
Cloutier

(10) Patent No.: US 9,079,233 B2
(45) Date of Patent: Jul. 14, 2015

(54) GAUGE KITS FOR SHEET BENDING BRAKES

(71) Applicant: Alexandre Cloutier, Orleans (CA)

(72) Inventor: Alexandre Cloutier, Orleans (CA)

( * ) Notice: Subject to any disclaimer, the term of this patent is extended or adjusted under 35 U.S.C. 154(b) by 181 days.

(21) Appl. No.: 13/874,787

(22) Filed: May 1, 2013

(65) Prior Publication Data

US 2014/0223754 A1 Aug. 14, 2014

Related U.S. Application Data

(60) Provisional application No. 61/763,016, filed on Feb. 11, 2013.

(51) Int. Cl.
*B21D 5/04* (2006.01)
*B21D 5/00* (2006.01)

(52) U.S. Cl.
CPC ..... *B21D 5/002* (2013.01); *B21D 5/042* (2013.01); *B21D 5/04* (2013.01)

(58) Field of Classification Search
CPC ..... B21D 5/006; B21D 5/04; B21D 5/002; B21D 5/042
USPC ..... 33/626, 623, 627, 628, 630, 374, 483, 33/484, 490, 478; 72/31.01, 31.09, 31.12, 72/318, 319
See application file for complete search history.

(56) References Cited

U.S. PATENT DOCUMENTS 404,164 A * 5/1889 Buckman ..... 72/319
846,248 A * 3/1907 Schmalz ..... 33/478
3,740,996 A * 6/1973 Hix ..... 72/461
4,240,279 A 12/1980 Rhoades
4,321,817 A 3/1982 Barnack
4,364,254 A 12/1982 Chubb et al.
4,372,142 A 2/1983 Rhoades
4,445,356 A 5/1984 Chubb et al.
4,489,583 A 12/1984 Rhoades
4,493,200 A 1/1985 Rhoades
4,494,397 A 1/1985 Rhoades
4,557,132 A 12/1985 Break
4,651,553 A 3/1987 Rhoades
4,671,094 A 6/1987 Break
4,766,757 A 8/1988 Break et al.
5,239,853 A 8/1993 Kutschker
5,259,230 A 11/1993 Beyers
5,343,728 A 9/1994 Chubb et al.
5,353,620 A 10/1994 Olsen et al.
5,505,069 A 4/1996 Break et al.
5,582,053 A 12/1996 Chubb et al.
5,582,055 A 12/1996 Chubb et al.
5,644,940 A 7/1997 Chubb et al.
5,657,662 A 8/1997 Kariofyllis
5,706,692 A 1/1998 Chubb et al.
5,706,693 A 1/1998 Chubb et al.
(Continued)

*Primary Examiner* — Christopher Fulton
(74) *Attorney, Agent, or Firm* — MU Patents; Timothy Marc Shropshire

(57) ABSTRACT

A kit is provided, including a body for mounting to the bending bar of a sheet bending brake having a first mounting assembly for mounting to the bending bar and a first predetermined portion of a second mounting assembly for mounting a gauge plate; a gauge plate having a second predetermined portion of the second mounting assembly and an upper surface against which sheet material being bent within the sheet bending brake will be supported; and a stop dimensioned to slide along the gauge plate and including a third mounting assembly to reversibly lock the stop to the gauge plate.

12 Claims, 13 Drawing Sheets

(56) References Cited

U.S. PATENT DOCUMENTS

| | | | | |
|---|---|---|---|---|
| 5,743,128 | A | 4/1998 | Liet | |
| 5,743,129 | A | 4/1998 | Chubb et al. | |
| 5,819,577 | A | 10/1998 | D'Arcy | |
| 5,860,312 | A | 1/1999 | Anderson | |
| 5,979,214 | A | 11/1999 | Fetsch et al. | |
| 6,085,569 | A | 7/2000 | Chubb et al. | |
| 6,145,367 | A * | 11/2000 | Peloquin et al. | 72/461 |
| 6,247,240 | B1 * | 6/2001 | Economaki | 33/484 |
| 6,325,367 | B1 * | 12/2001 | Russell | 269/317 |
| 6,389,864 | B1 | 5/2002 | Chubb et al. | |
| 6,675,619 | B2 | 1/2004 | Clark | |
| 6,748,783 | B1 * | 6/2004 | Chubb et al. | 72/294 |
| 6,925,846 | B2 * | 8/2005 | Perruccio | 72/319 |
| 6,949,580 | B2 | 9/2005 | Hale et al. | |
| 7,021,096 | B2 | 4/2006 | Barnett | |
| 7,043,950 | B2 * | 5/2006 | Clark et al. | 72/31.1 |
| 7,191,631 | B2 | 3/2007 | Break | |
| 7,412,862 | B2 | 8/2008 | Anderson et al. | |
| 7,454,943 | B2 | 11/2008 | Jacobsen | |
| 7,549,311 | B2 | 6/2009 | Break | |
| 7,669,451 | B2 | 3/2010 | Break | |
| 7,685,858 | B2 | 3/2010 | Allen et al. | |
| 7,836,743 | B1 | 11/2010 | McCoy | |
| 7,954,352 | B2 | 6/2011 | Allen et al. | |
| 7,963,044 | B1 * | 6/2011 | Bartholomew | 33/374 |
| 2002/0121025 | A1 * | 9/2002 | Leite | 33/374 |
| 2007/0266576 | A1 * | 11/2007 | Vaes | 33/374 |
| 2012/0266471 | A1 * | 10/2012 | Chao | 33/478 |

* cited by examiner

PRIOR ART

GAUGE KITS FOR SHEET BENDING BRAKES

RELATED APPLICATION

This application claims priority under 35 USC 119 from U.S. Provisional Application No. 61/763,016 filed Feb. 11, 2013.

FIELD OF THE INVENTION

This invention relates to sheet bending brakes, and more particularly to demountable and fixed gauges for measuring sheet material to be bent or cut in a sheet bending brake.

BACKGROUND

A sheet metal bending brake, commonly referred to as a brake, typically consists of a flat surface (bottom member) onto which the material (sheet metal) is placed, and a clamping bar which will come down and hold the material firmly during the bending process. This clamping action may be manual, automatic or operated using a foot pedal. The front, gate-like, plate of the machine is hinged and may be lifted, forcing the material extended over a straight edge to bend to follow the plate. The bends may be to any angle up to a typical practical limit of about 120 degrees, somewhat more in the case of a bar folder. If the area to be bent is narrow enough, a sharper bend (e.g., for a hem) can be made by inserting the bend under the clamping bar and lowering it.

The frame of such a brake is typically comprised of an interconnected series of flattened C-shaped members that open frontward and hold the top and bottom members at corresponding top and bottom lips of the C-shape. The flattened C-shaped members being rigidly connected to longitudinal members forming part of the brake frame. Sheet bending brakes of this character are well known, and many are designed to be portable so that they can be transported for use at temporary work sites, typically to be set up on sawhorses or the like. Therefore, such brakes must be rugged, and any accessories must likewise be rugged and also capable of being quickly and easily assembled and disassembled, if the accessories protrude from the main body of the brake, or adapted to meet the requirements of the current sheet metal bending required.

Currently, commercial sheet bending brakes are generally available with lengths from approximately 2 meters (approximately 6.5 feet) to 4.5 meters (approximately 14.5 feet). Typically, an approximately U-shaped handle is provided on top for actuating the clamping/unclamping action of the top member. Similarly, a pair of straight handles, or alternatively U-shaped or other shaped handles, hang downward from the bending member such that an operator can reach down, grasp the handle, and pivotably lift it to bend the clamped sheet material over the bending anvil. Typically, the sheet material is 24" wide, possibly supplied from a coil or roll, and as a "workpiece" the sheet material extends forward out away from the top and bottom clamping members. The operator, typically a single individual, must align the desired bending line of the sheet material (workpiece) with the bending anvil, and then both support and hold in position the sheet material with one hand while reaching over to close the clamp with their other hand. Then the operator must reach down and pull up the bending member handle, possibly while still supporting the sheet material with one hand. Therefore, a problem associated with conventional sheet bending brakes is providing support for the sheet material extending in front of the brake. Particularly for longer pieces of sheet material, an assistant to the operator may be needed, but of course this adds to labor costs.

This issue is exacerbated where, with typical sheet material being 24" wide, a 1" bend requires that the flattened C-shaped members of the frame accept 23" of sheet material. As such, for the brake to accommodate the fullest range of bends then the frame should essentially accommodate 24" minus the smallest length of the bent section, for example 0.5'. Accordingly, it would be beneficial for the brake frame and flattened C-shaped members to be large enough to support the range of bends desired by the user but have minimum footprint for ease of storage etc.

Another problem associated with conventional sheet bending brakes lies in squaring sheet material with respect to the bending anvil as the sheet material is inserted into the brake. That is, it is generally desired that bends or cuts in the sheet material made with the assistance of the sheet bending brake be square and parallel to an edge of the sheet material and to each other. Making the cuts or bends square to the material edge can be a time-consuming operation, resulting in undesirable expense and scrap. Accordingly, it would be beneficial for the operator to have rapid simple visual assurance that the sheet was square within the bending brake prior to committing to the bend.

Another problem with conventional sheet bending brakes is the labor and expense associated with formation of compound bends (including hems) in the sheet material when forming building trim elements and the like. For example, it is conventional practice to employ a ruler or scale to make marks at the ends of a length of sheet material, and to use these opposed marks in an effort not only to square the sheet material in the bending brake but also to locate the positions of the desired bends or cuts. For compound bends, marks may need to be made on both sides of the sheet. Another conventional technique is to employ a small strip of material, such as scrap material, to form the desired contour or profile of the trim element, including multiple bends and hems as desired. When the strip has been bent to a satisfactory contour, it is then flattened again in such a way that the stresses imparted to the strip material at each bend are plainly visible as marks on the flattened strip, thereby generating a "template strip". The template strip is then placed in turn along each end of the sheet of material to be contoured and manual cutters or snips are used to mark the longitudinally spaced material ends at lateral positions at which the material sheet is to be bent or cut. After the sheet is bent and cut, the ends having the snip marks usually must be trimmed off. It is self-evident that this is a time-consuming and expensive operation that undesirably increases the costs of building construction. Accordingly, it would be beneficial to provide a means of allowing the brake operator to perform bending operations without marking the sheet material reducing time required per bend but also reducing waste from incorrect measurements. In some instances where the brake user regularly performs similar operations it would be beneficial to provide them with quick visual markers for aligning the sheet metal thereby further reducing required time and waste. It would also be beneficial to provide the user with easily adjustable and accurately settable gauges and other aids or accessories could significantly improve an operator's efficiency in such situations.

Other aspects and features of the present invention will become apparent to those ordinarily skilled in the art upon review of the following description of specific embodiments of the invention in conjunction with the accompanying figures.

SUMMARY

It is an object of the present invention to mitigate limitations in the prior art relating to sheet bending brakes, and more particularly to demountable and fixed gauges for measuring sheet material to be bent or cut in a sheet bending brake.

In accordance with an embodiment of the invention there is provided a kit comprising a body for mounting to the bending bar of a sheet bending brake comprising a first mounting means for mounting to the bending bar and a first predetermined portion of a second mounting means for mounting a gauge plate, a gauge plate comprising a second predetermined portion of the second mounting means and an upper surface against which sheet material being bent within the sheet bending brake will be supported, and a stop dimensioned to slide along the gauge plate and comprising a third mounting means to reversibly lock the stop to the gauge plate.

In accordance with an embodiment of the invention there is provided a kit comprising a gauge plate comprising a first mounting means and an upper surface against which sheet material being bent within the sheet bending brake will be supported, the first mounting means supporting mounting of the gauge plate to a bending bar of a sheet bending brake, and a stop dimensioned to slide along the gauge plate and comprising a second mounting means to reversibly lock the stop to the gauge plate.

BRIEF DESCRIPTION OF THE DRAWINGS

Embodiments of the present invention will now be described, by way of example only, with reference to the attached Figures, wherein.

DETAILED DESCRIPTION

The present invention is directed to sheet bending brakes, and more particularly to demountable and fixed gauges for measuring sheet material to be bent or cut in a sheet bending brake.

The ensuing description provides exemplary embodiment(s) only, and is not intended to limit the scope, applicability or configuration of the disclosure. Rather, the ensuing description of the exemplary embodiment(s) will provide those skilled in the art with an enabling description for implementing an exemplary embodiment. It being understood that various changes may be made in the function and arrangement of elements without departing from the spirit and scope as set forth in the appended claims.

A "sheet bending brake" (brake) as used herein and throughout this disclosure, refers to a metalworking machine that allows the bending of sheet metal. A brake as employed within the specification and descriptions relating to embodiments of the invention are primarily associated with cornice brakes, which allow for simple bends and creases to be formed within a sheet material. However, a brake may also refer to a box-and-pan brake, allowing the formation of box and pan shapes; a press brake or brake press, allowing formation of bends using a punch and die; and a bar folder, which typically clamps and bends in a single motion, although the depth is usually less than cornice or box-and-pan brakes provide. A brake may also be known as a bending machine or bending brake.

Figure 1:
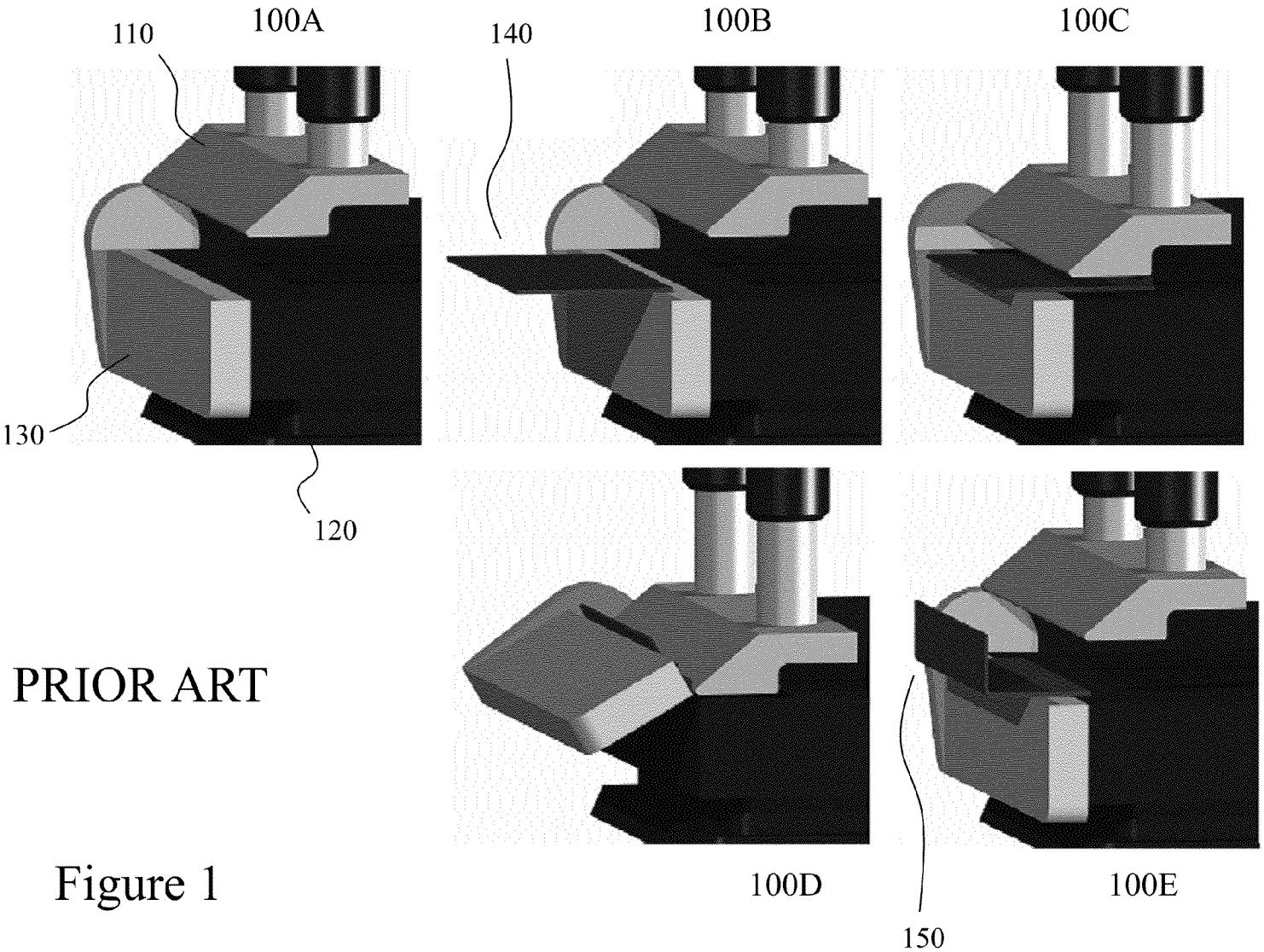
PRIOR ART Figure 1
FIG. 1 depicts operation of a brake according to the prior art.

FIG. 1 depicts the operation of a brake, specifically a cornice brake, according to the prior art in first to fifth images 100A to 100E respectively. Whilst FIG. 1 depicts a hydraulic brake the sequence of steps are the same as with a manual brake. As depicted in first image 100A, the brake comprises upper clamp 110, frame 120, and bending plate 130. Next in second step 100B the sheet material 140 is brought between the upper clamp 110 and frame 120 before being positioned at the right location in step 100C. The bending plate 130 is now pivoted as depicted in fourth image 100D from its rest position to the desired angle on the plate wherein as the bending plate 130 moves the sheet material forms the bend within the sheet material where the corner of the bend forms at the forward edge of the upper clamp 110. Bending plate 130 is typically rotated to angles between 30° and 120° according to the desired profile to be formed. Once rotated to the desired angle the bending plate 130 is returned to its original position as shown in fifth image 100E wherein the bent sheet material 150 is removed from the brake and the process either repeated on the same piece of sheet material to add another bend or with a new piece of sheet material.

Figure 2:
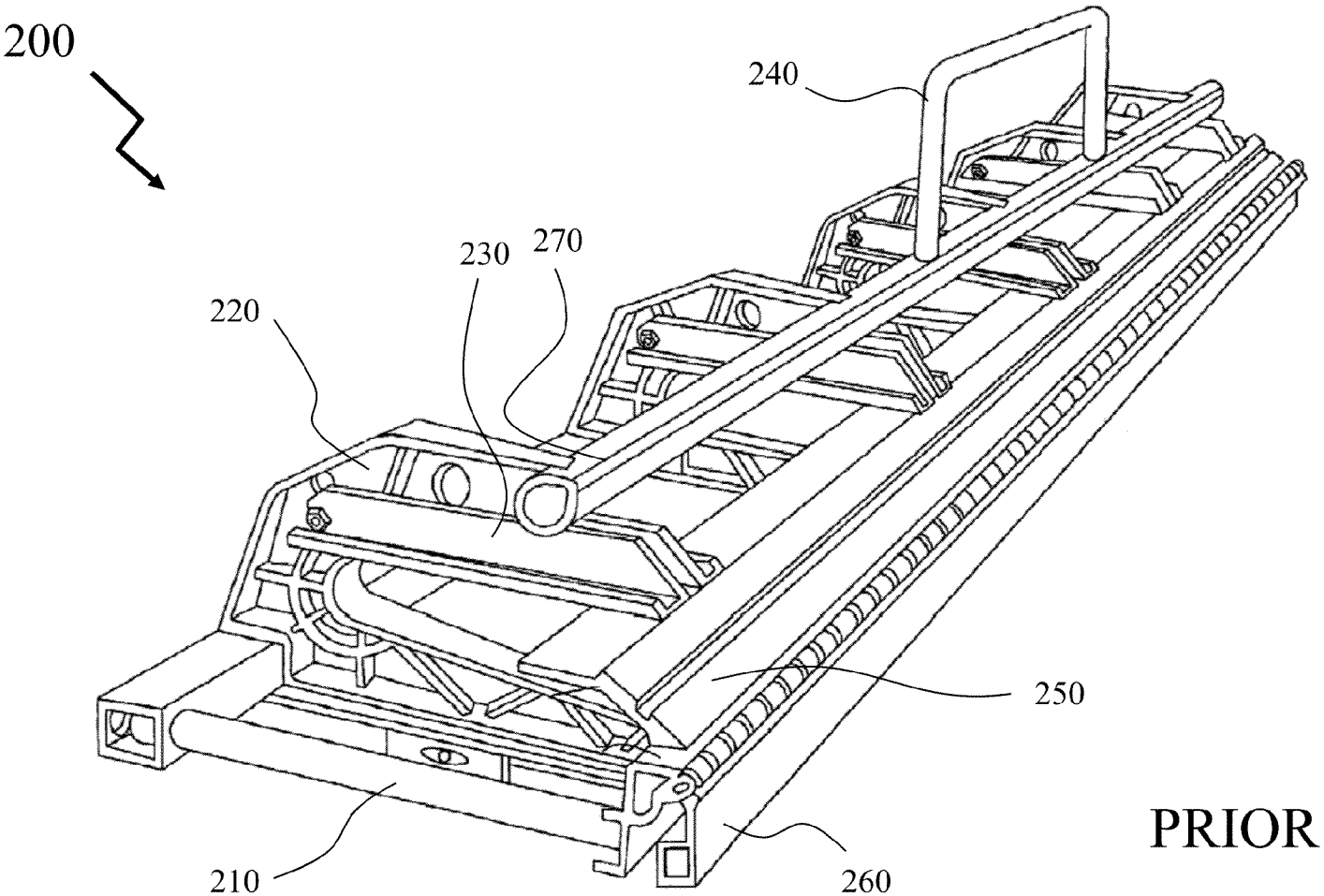
PRIOR ART Figure 2
FIG. 2 depicts an example of a prior art brake.

Now referring to FIG. 2 there is depicted an example of a prior art manual portable brake 200. As shown brake 200 comprises a rectangular sub-frame 210 upon which a plurality of flattened C-frames 220 are mounted along the length of the sub-frame 210. Attached to each flattened C-frame 220 is a mount 230 projecting forward to which is attached the upper clamp 250. Also mounted to the frame 210 is bending plate 260, this mounting being via an approach that allows the bending plate 260 to pivot about the mounting such that the bending plate 260 may be raised such that sheet material inserted into the open sides of the flattened C-frames 220 is bent against the upper clamp 250. Also attached to the upper portions of the flattened C-frames 220 via bar 270 is handle 240. Not shown, for clarity, are the handle attached to the bending plate 260 for the user to grip and pull-push during the bending operation.

Figure 3:
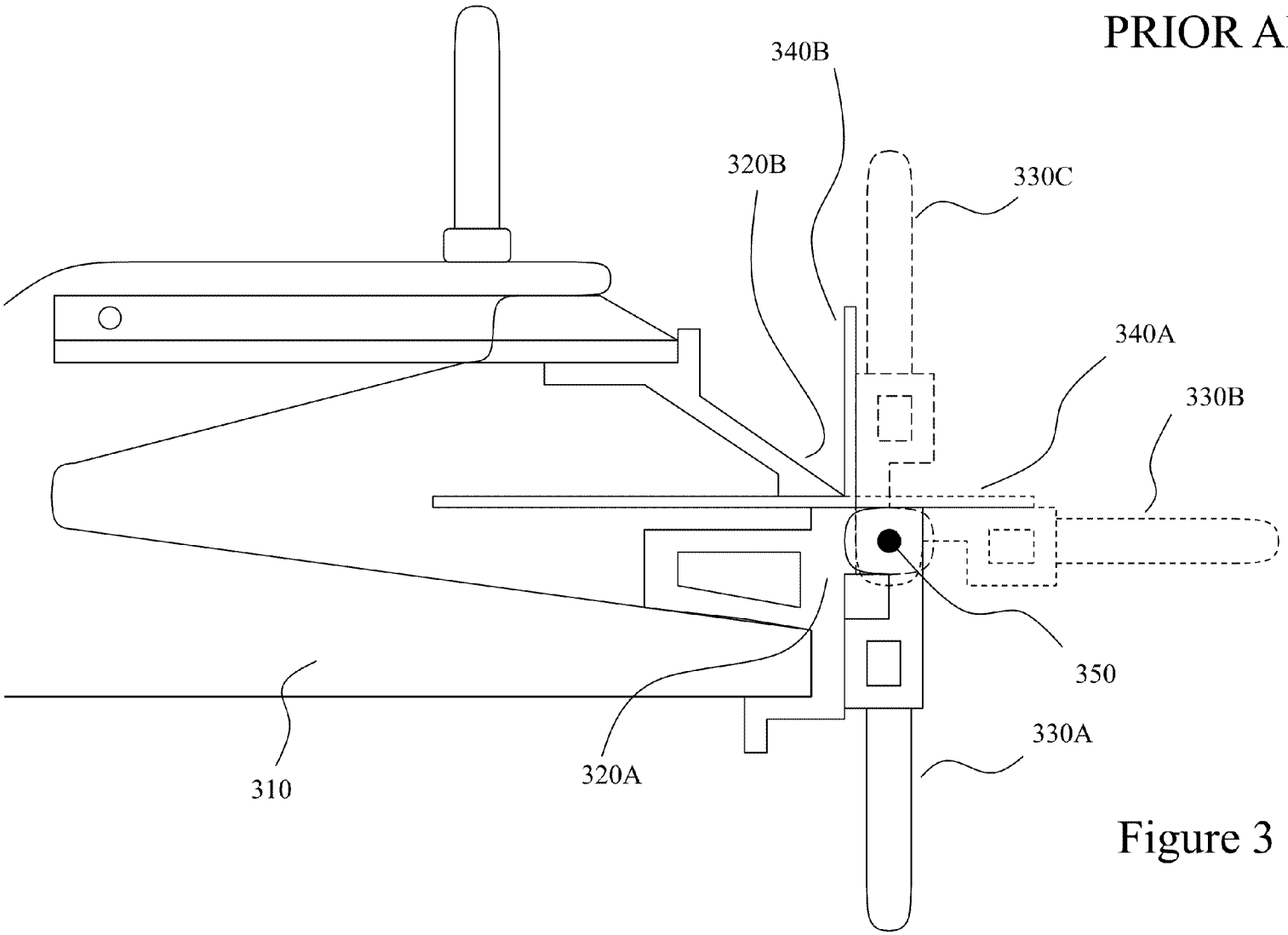
FIG. 3 depicts schematically operation of a prior art brake.

Referring to FIG. 3 there is depicted schematically the operation of a prior art brake, such as brake 200 described supra in respect of FIG. 2. As shown, a flattened C-frame 310 has a lower clamp plate 320A on its lower side and an upper clamp 320B attached to its upper portion wherein the sheet material 340A is inserted between them. The bending plate is depicted in this instance with the handle and three positions, these being base position 330A, first position 330B, and end position 330C. As the bending plate 330 is rotated about pivot (mounting) 350 then between first position 330B and end position 330C it is folding the sheet material 340A to bent sheet 340B. As such the bending plate 330 must be rotated an initial angle, e.g. 90°,between base position 330A and first position 330B, before being rotated the desired angle of the bend, e.g. 90°, 120°, or 60°. Accordingly, it would be evident that between base position 330A and first position 330B effort/time is wasted moving the bending plate 330 for no effect upon the sheet material 340A.

Figure 4:
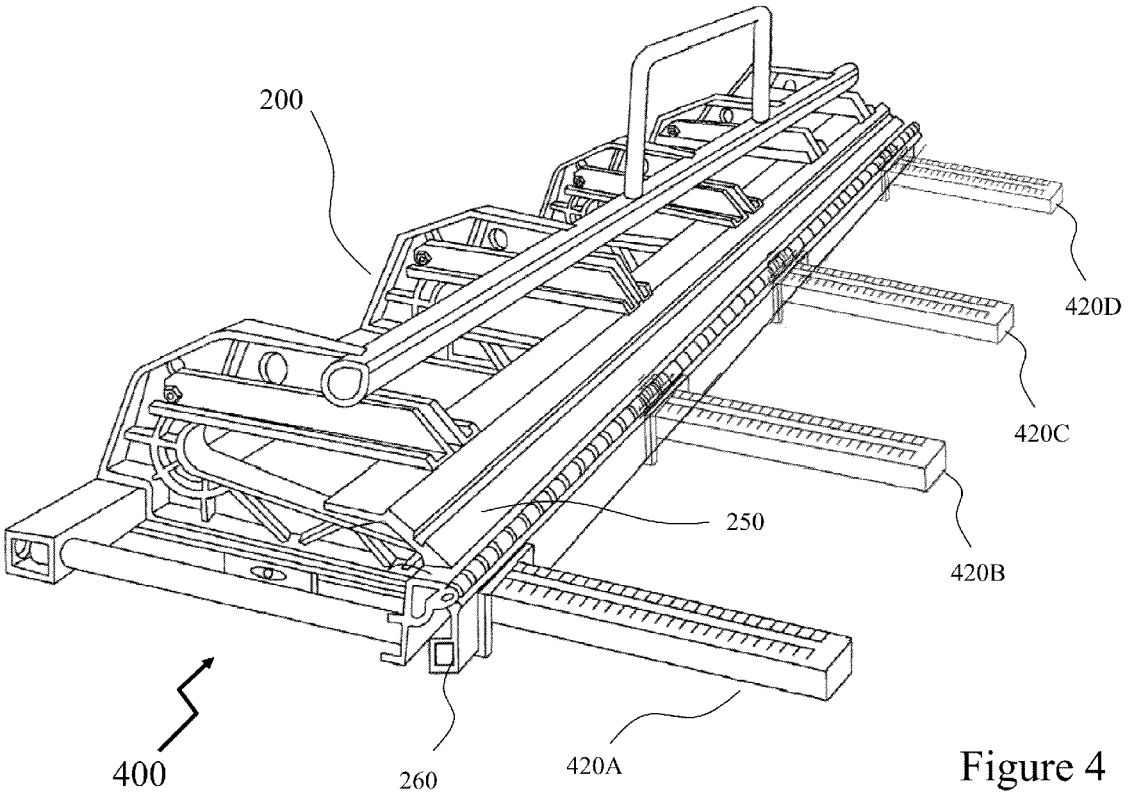
FIG. 4 depicts a brake according to an embodiment of the invention.
Figure 10:
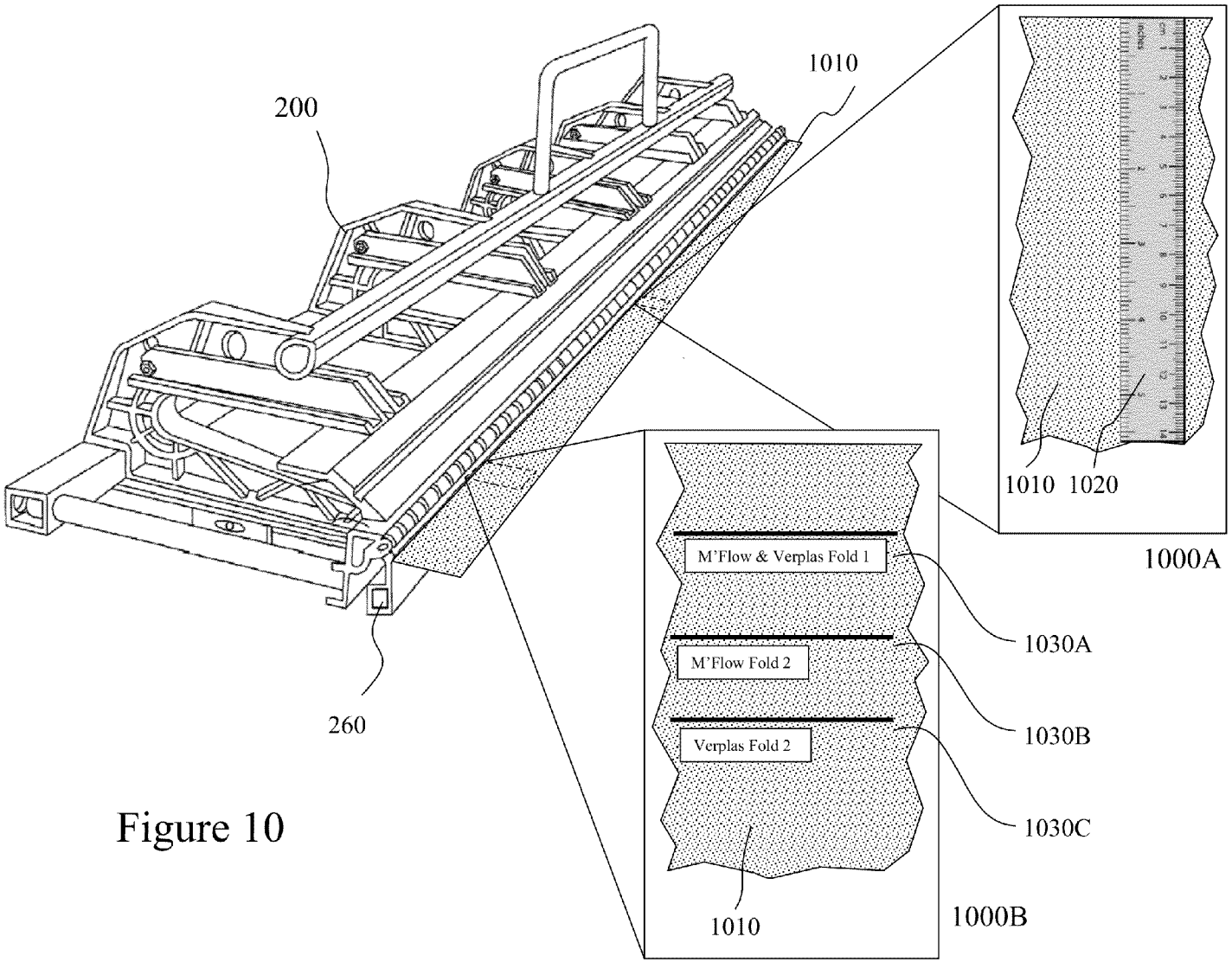
FIG. 10 depicts a brake according to an embodiment of the invention with continuous gauge.

Now referring to FIG. 4 there is depicted a brake 400 according to an embodiment of the invention. As depicted a conventional brake 200, such as described supra in respect of FIG. 2, as attached to the front surface of the bending plate 260 a series of gauges 420A through 420D respectively allowing the brake operator to determine the correct position for the sheet material prior to bending it as well as verifying that the sheet material has the correct orientation to the bending plate 260 and upper clamp 250. This may typically be that the edge of the sheet material is parallel to the upper clamp 250 although it would be evident that the series of gauges 420A through 420D may be also marked, as described below in respect of FIG. 10 for example, in a manner to support other predetermined angular offsets between upper clamp 250 and sheet material edge.

Figure 5:
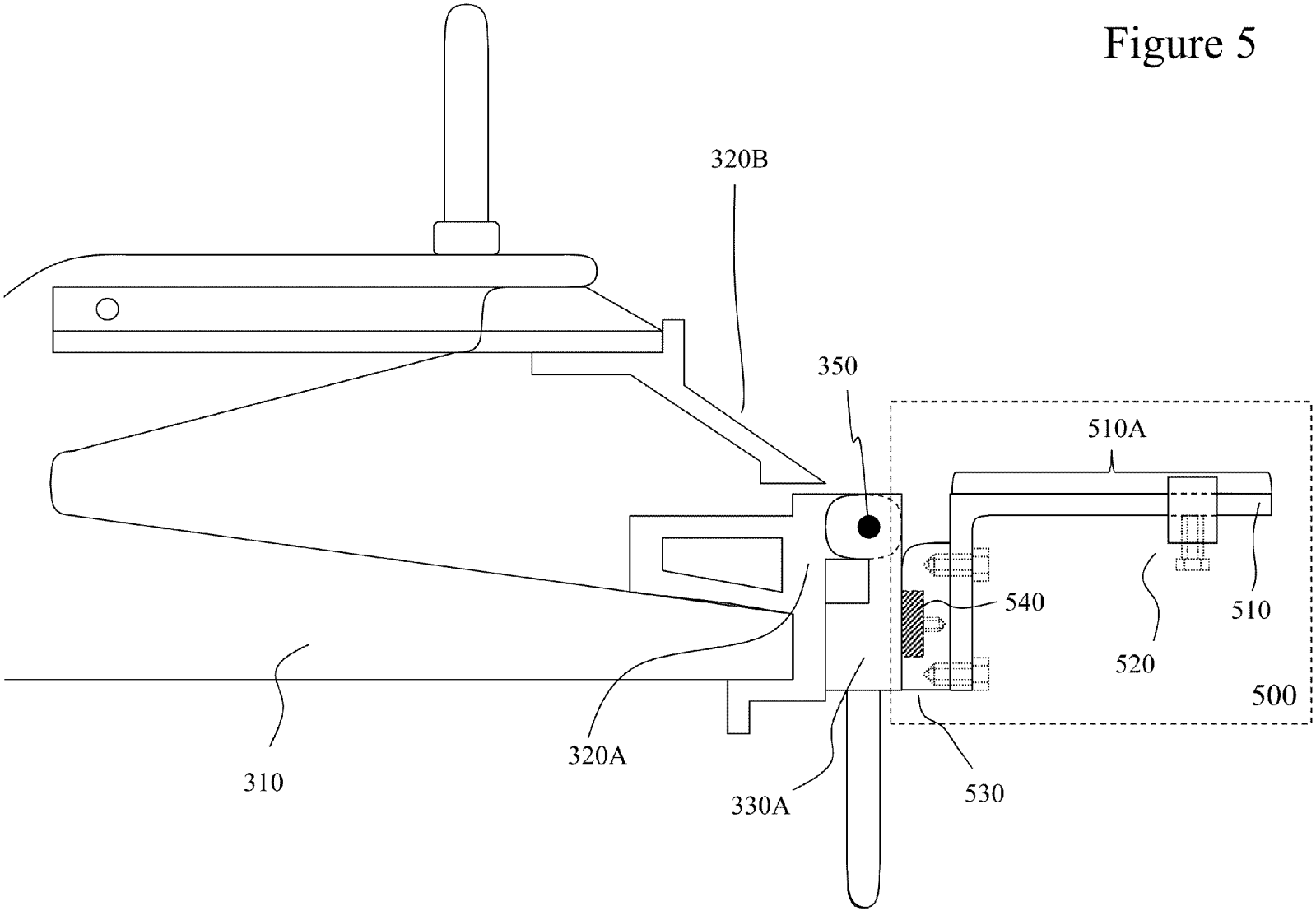
FIG. 5 depicts a brake according to an embodiment of the invention with a demountable gauge and stop means.

Referring to FIG. 5 there is depicted a brake according to an embodiment of the invention with a demountable gauge and stop means. The depicted portions of the brake being flattened C-frame 310, lower frame element 320A, and upper clamp 320B whilst other elements have been omitted for clarity. Towards the front of lower frame element 320A a pivot 350 supports a bending plate 330A such as described supra in respect of FIGS. 2 and 3. Attached to bending plate 330A is gauge and stop assembly 500. Gauge and stop assembly 500 comprises body 530, bracket 510, and stop 520. Body 530 as depicted contains a magnet 540 to mount the gauge and stop assembly 500 to the bending plate 330A which in this instance may be made from steel or austenitic stainless steel. Accordingly, the upper surface of the bracket 510, denoted as surface 510A, supports the sheet material as the user is aligning and positioning it plus provides as discussed below in respect of FIG. 10 markings supporting the user making the bends in the correct positions. Additionally, stop 520 may be positioned and fixed into position on bracket 510 allowing the sheet material to be positioned within increased ease. Accordingly, the gauge and stop assembly 500 is removed and the bending plate 330A rotated to bend the sheet material to the desired angle.

Figure 6:
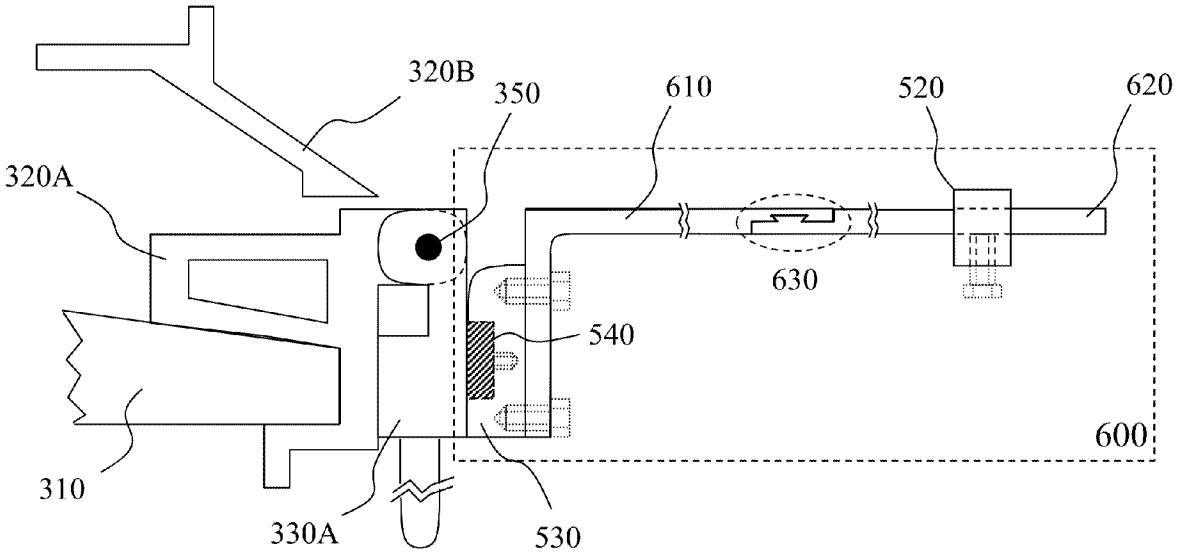
FIGS. 6 and 7A depict brakes according to embodiments of the invention with user extendable demountable gauges and stop means.
Figure 7A:
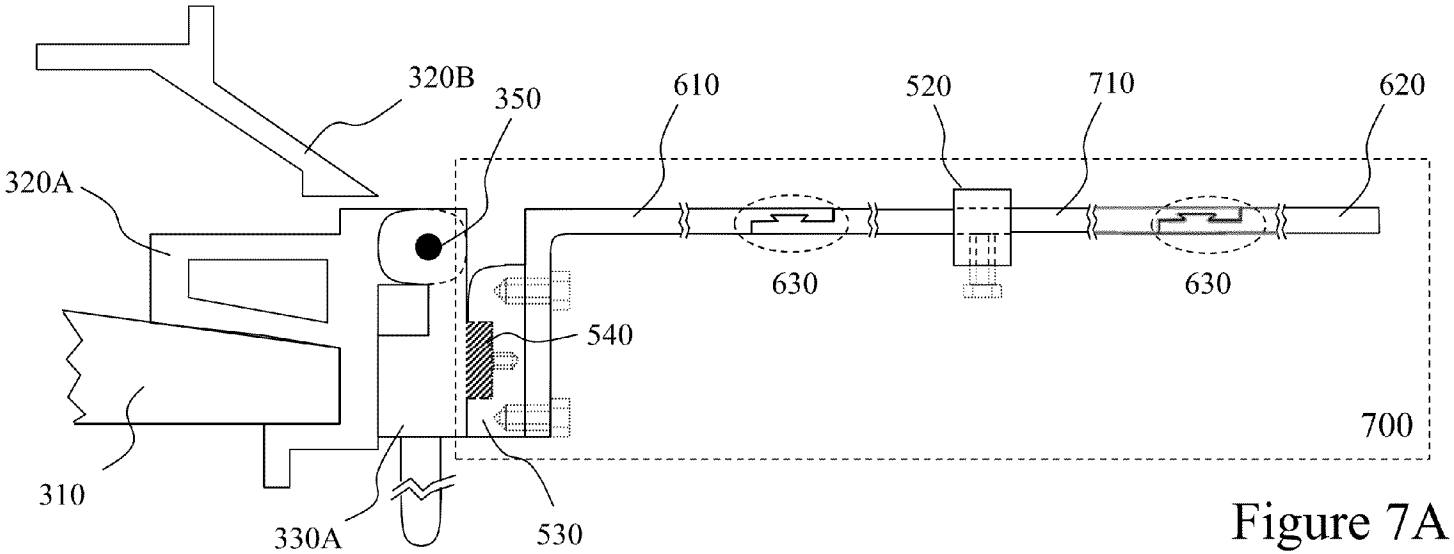

Referring to FIGS. 6 and 7A there are depicted first and second gauge and stop assemblies 600 and 700 attached to brakes according to embodiments of the invention. As discussed supra in respect of FIG. 5, the depicted portions of the brake are flattened C-frame 310, lower frame element 320A, and upper clamp 320B with other elements having been omitted for clarity. Towards the front of lower frame element 320A a pivot 350 supports a bending plate 330A such as described supra in respect of FIGS. 2 and 3 whilst attached to bending plate 330A are first and second gauge and stop assemblies 600 and 700 respectively in FIGS. 6 and 7 respectively. Each of the first and second gauge and stop assemblies 600 and 700 comprises a body 530 with magnet 540 for mounting the respective assembly to the bending plate 330A. Referring to FIG. 6, then attached to the body 530 is bracket 610 which terminates away from the brake with first predetermined portion of an attachment means 630. Accordingly, the gauge provides a first range of lengths for the user of the brake. However, attachment of plate 620 to bracket 610 provides for an extension of the gauge length. Plate 620 comprises at one end a second predetermined portion of the attachment means. However, as evident in FIG. 7A an extender plate 710 may be attached to the end of bracket 510 and then plate 620 attached to the extender plate thereby providing for a further increase in gauge length.

Figure 7B:
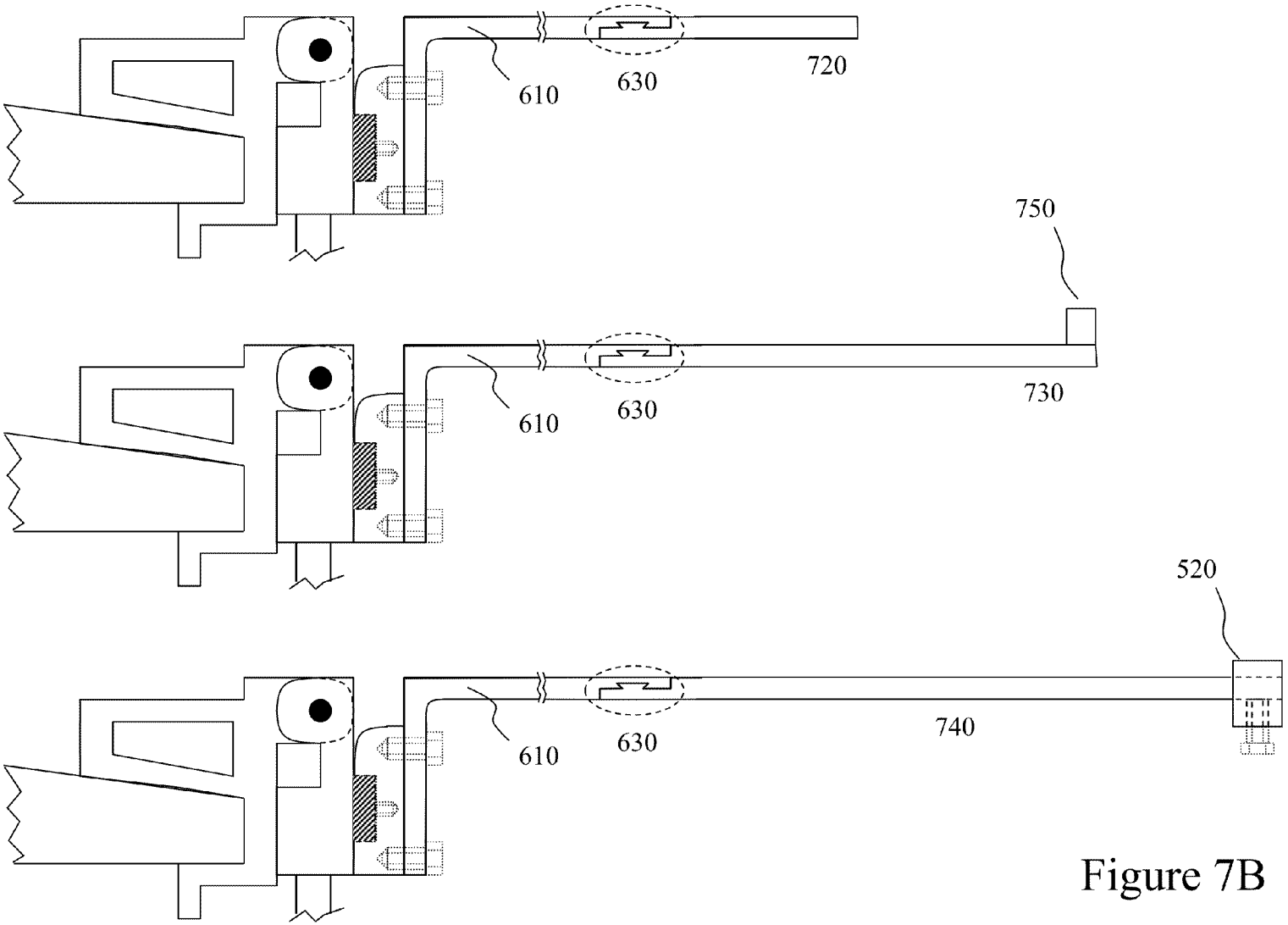
FIG. 7B depicts a brake according to an embodiment of the invention with multiple demountable gauges.

Alternatively, a plurality of different length gauge extension plates may be attached to bracket 610 as depicted in FIG. 7B wherein first to third custom plates 720 to 740 respectively are attached by common attachment means 630 to the bracket 610. As discussed below in respect of FIG. 10, gauge may have ruled dimensions upon their upper surface allowing the brake user to determine where to place the edge of the sheet material or be marked with other text/markings which make the process easier for the user. Accordingly, first to third custom plates 720 to 740 respectively may be provided to reflect different bend designs being processed and simply require that the brake user align the sheet material edge to a permanent stop 750 attached to the plate or that the brake user attach the stop 520 to the end or with respect to a mark on the plate.

Figure 8:
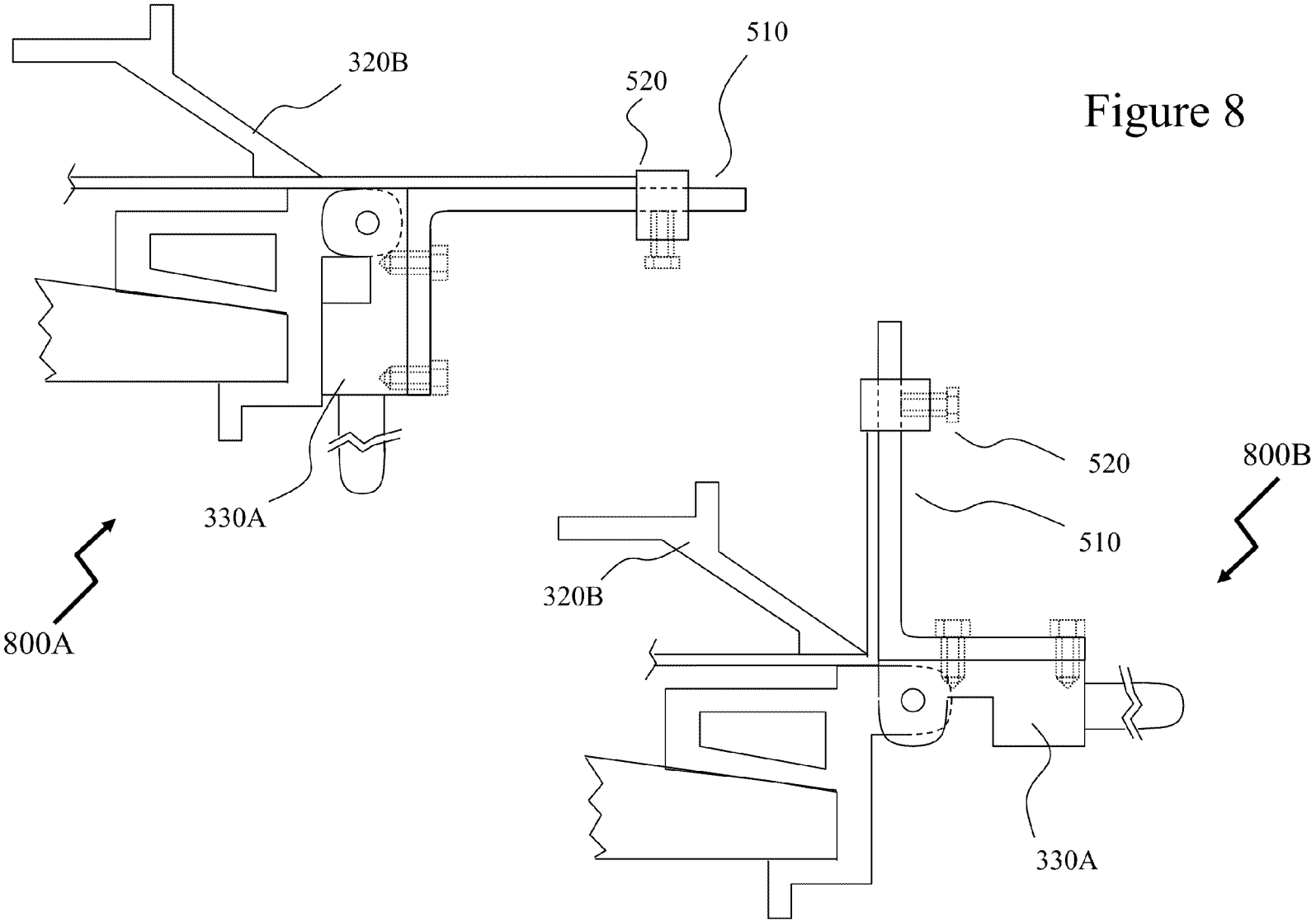
FIG. 8 depicts a brake according to an embodiment of the invention with mounted gauge and stop means.

Referring to FIG. 8 there is depicted in first and second images 800A and 800B operation of a brake according to an embodiment of the invention with mounted gauge and stop means. As depicted in first image 800A a bracket 510, such as described above in respect of FIG. 5, is attached to the bending plate 330A directly without body 530 and hence without magnet 540 for demountable gauge attachment. Accordingly, rotation of the bending plate now pushes the bracket 510 against the sheet material and begins bending the sheet material at the edge of the upper clamp 320B as the bending plate 330A is rotated 90° as shown in second image 800B. Accordingly, bracket 510 performs the bending of the sheet material rather than the bending plate 330A as within a prior art brake as discussed supra in respect of FIGS. 2 and 3. Beneficially, in this configuration the stop 520 prevents slippage of the sheet material away from the brake.

Figure 9:
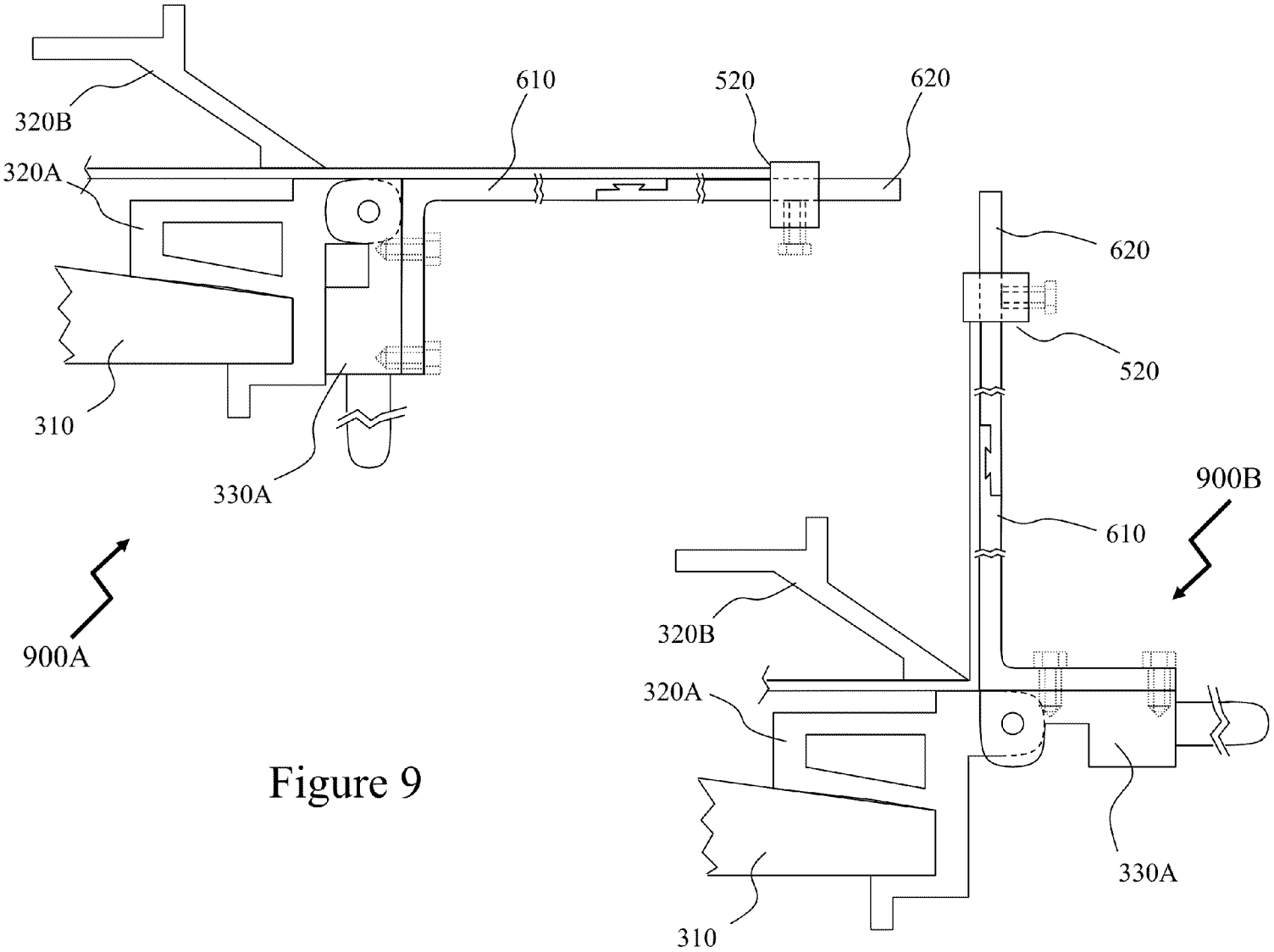
FIG. 9 depicts a brake according to an embodiment of the invention with mounted extendible gauge and stop means.

Referring to FIG. 9, there is depicted a brake according to an embodiment of the invention such as described supra in respect of FIG. 6 with mounted extendible gauge and stop means although as with FIG. 8 the body 530 with magnet 540 has been removed and the bracket 610 directly attached to the bending plate 330A. Accordingly, as depicted in first and second images 900A and 900B respectively, rotation of the bending plate 330A by 90° as opposed to 180° bends the sheet material at the desired point. Now referring to FIG. 10, there is depicted a brake 200 with bending plate 260, such as described supra in respect of FIG. 2, modified according to an embodiment of the invention with Continuous Gauge 1010 attached to the bending plate 260. First and second details 1000A and 1000B respectively depict details of Continuous Gauge 1010 wherein within first detail 1000A a ruled section 1020 of the Continuous Gauge 1010 allows the user to make the desired bend by aligning the edge of the sheet material at the desired distance. In contrast, second detail 1000B first to third marks 1030A to 1030C respectively denote positions for the edge of the sheet material which are denoted by identifiers of the bend/product being manufactured rather than a ruled gauge. Accordingly, the user can see that for each of the "Master Flow" (M'Flow) and "Verplas" products the first bend is made with the sheet material at first mark 1030A. However, for these products the second bends are made at different positions as denoted by second and third marks 1030B and 1030C respectively for the "M'Flow" and "Verplas" products respectively. In this manner, repetitive bends in standard geometries may be identified upon the gauges and allow for reduced error/waste as working with the ruled gauge is replaced with simple clear markers. In some instances of the invention it would be evident that a manufacturer may sell as set of gauges commercially allowing, for example, HVAC engineers to repair their ducting products or make custom fittings to interface to their standard ducting etc.

Figure 11:
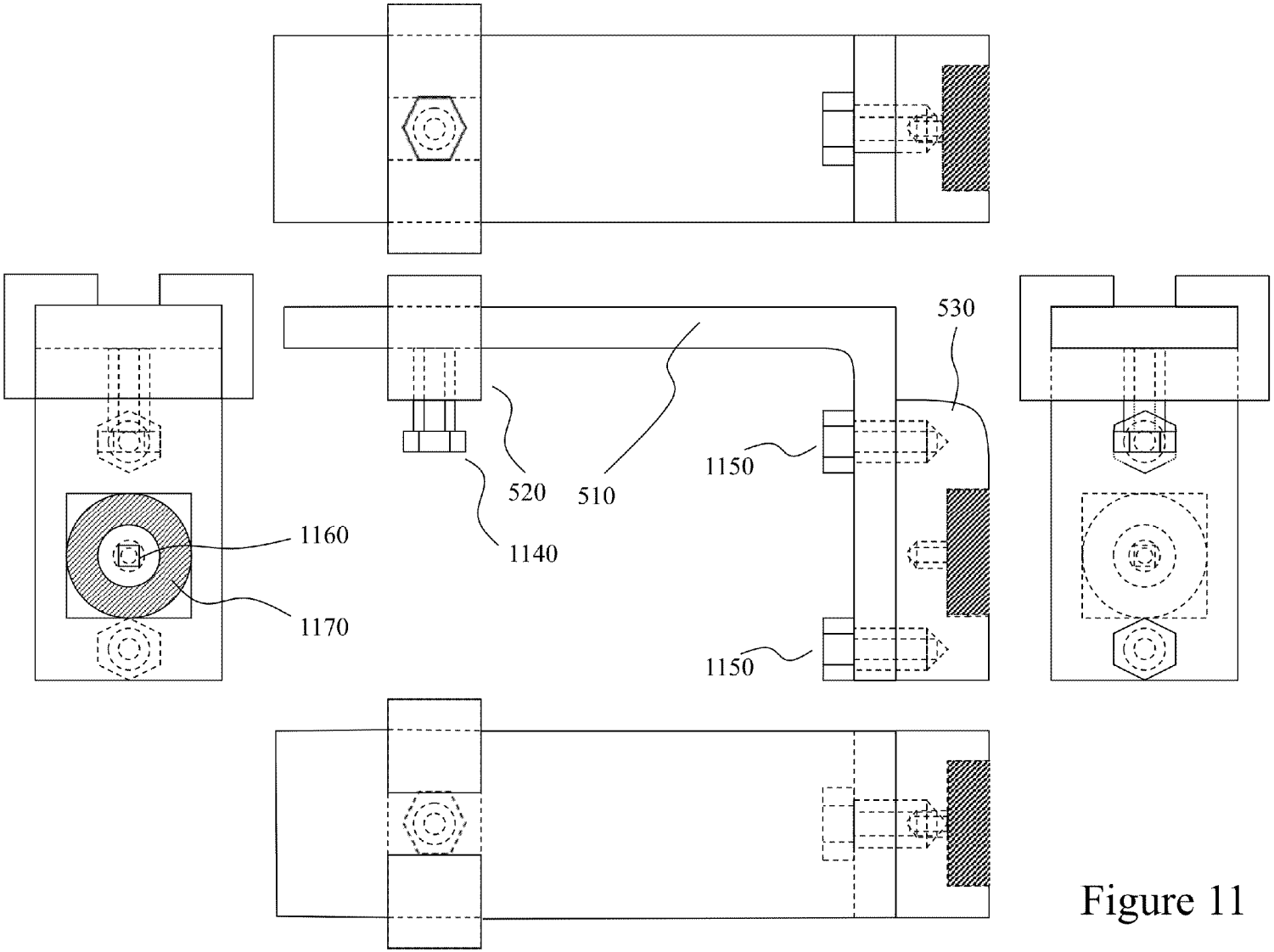
FIG. 11 depicts a demountable gauge and stop means according to an embodiment of the invention as employed in FIG. 5.
Figure 12:
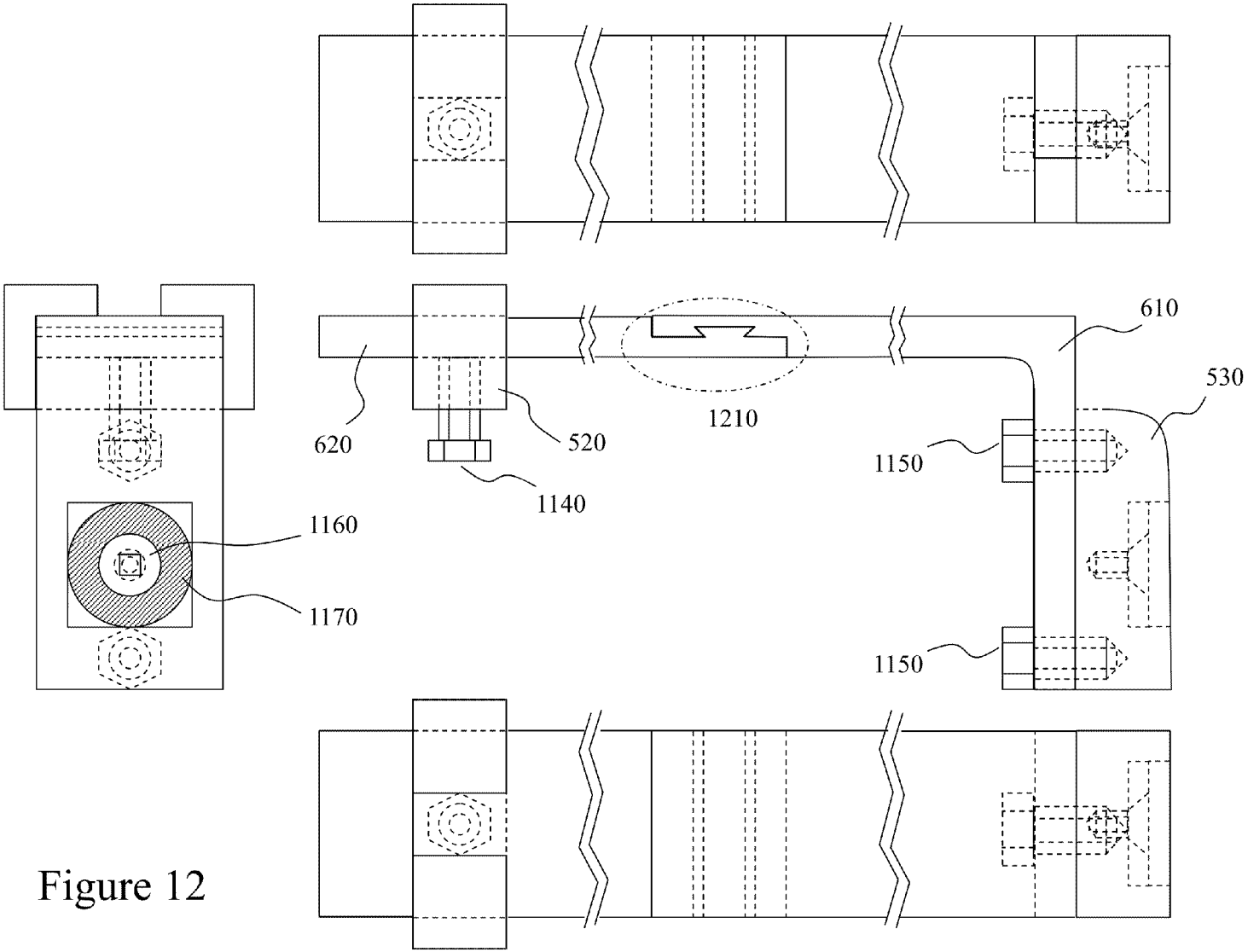
FIG. 12 depicts a demountable gauge and stop means according to an embodiment of the invention as employed in FIGS. 6 and 7.

Now referring to FIG. 11, there is depicted a demountable gauge and stop means according to an embodiment of the invention such as described supra in respect of FIG. 5 with the body 530 and without in FIG. 8. As depicted, the bracket 510 is attached to the body 530 via hex-head screws 1150 although other attachment means may be employed without departing from the scope of the invention. Similarly stop 520 is locked into position on bracket 510 using bolt 1140 and magnet 1170 retained within body 530 by flat head bolt 1160. Similarly, referring to FIG. 12, there is depicted a demountable gauge and stop means according to an embodiment of the invention such as described supra in respect of FIG. 6 with the body 530 and without in FIG. 9. In this instance, the bracket 610 is attached to the body 530 via hex-head screws 1150 although other attachment means may be employed without departing from the scope of the invention. Similarly, stop 520 is locked into position on bracket 610 or plate 620 using bolt 1140 and again the magnet 1170 is retained within body 530 by flat head bolt 1160. The plate 620 is attached to the bracket 610 by tongue-and-groove mounting 1210 although it would be evident that other mounting means may be employed without departing from the scope of the invention.

Figure 13:
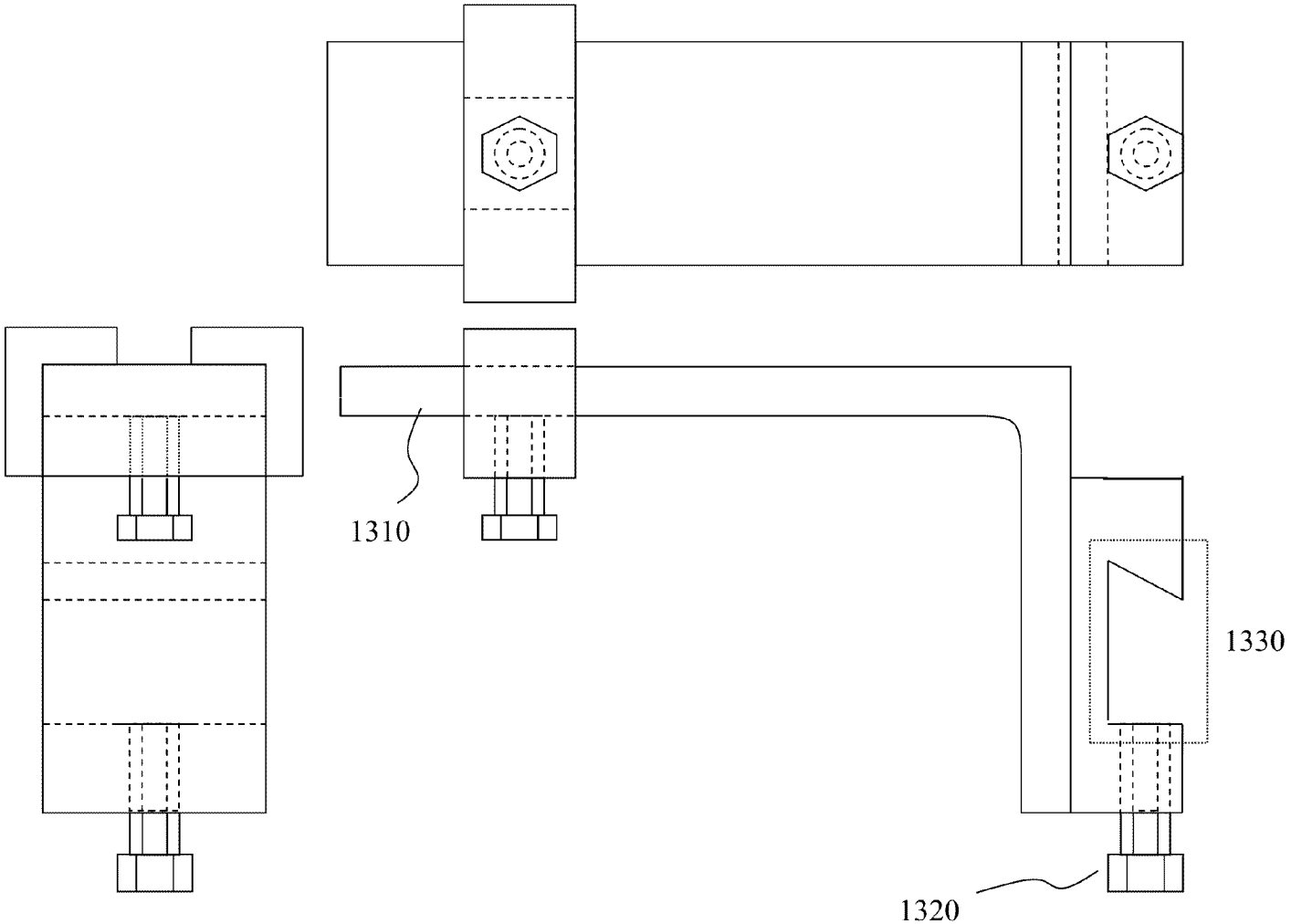
FIG. 13 depicts a demountable gauge and stop means according to an embodiment of the invention for use with a different brake bar configuration.

Now referring to FIG. 13 there is depicted a demountable gauge and stop means according to an embodiment of the invention for use with a different brake bending bar configuration wherein the bracket 1310 mounts to the bending bar, not shown for clarity, through mount 1330 and may be mounted/removed with ease or locked with retaining bolt 1320. It would be evident that in other embodiments of the invention a range of bodies, such as described supra in respect of FIGS. 4 to 7B and FIG. 11, may be provided as part of a kit allowing a set of gauges with or without extender plates to be mounted to a variety of brakes supplied by one or more manufacturers.

Specific details are given in the above description to provide a thorough understanding of the embodiments. However, it is understood that the embodiments may be practiced without these specific details. Implementation of the techniques, blocks, steps and means described above may be done in various ways.

The foregoing disclosure of the exemplary embodiments of the present invention has been presented for purposes of illustration and description. It is not intended to be exhaustive or to limit the invention to the precise forms disclosed. Many variations and modifications of the embodiments described herein will be apparent to one of ordinary skill in the art in light of the above disclosure. The scope of the invention is to be defined only by the claims appended hereto, and by their equivalents.

Further, in describing representative embodiments of the present invention, the specification may have presented the method and/or process of the present invention as a particular sequence of steps. However, to the extent that the method or process does not rely on the particular order of steps set forth herein, the method or process should not be limited to the particular sequence of steps described. As one of ordinary skill in the art would appreciate, other sequences of steps may be possible. Therefore, the particular order of the steps set forth in the specification should not be construed as limitations on the claims. In addition, the claims directed to the method and/or process of the present invention should not be limited to the performance of their steps in the order written, and one skilled in the art can readily appreciate that the sequences may be varied and still remain within the spirit and scope of the present invention.

The invention claimed is:

1. A kit comprising:

a body for mounting to the bending bar of a sheet bending brake comprising a first mounting means for mounting to the bending bar and a first predetermined portion of a second mounting means for mounting a gauge plate to said bending bar;

said gauge plate comprising a second predetermined portion of the second mounting means and an upper surface against which sheet material being bent within the sheet bending brake is supported; and a stop dimensioned to slide along the gauge plate and comprising a third mounting means to reversibly lock the stop to the gauge plate.

2. The kit according to claim 1 further comprising;

a first predetermined portion of a fourth mounting means disposed at a second distal end of the gauge plate for demountably attaching an extender gauge plate to the gauge plate;

the extender gauge plate cross-sectionally dimensioned for compatibility with the gauge plate to allow the stop to move between gauge plate and extender gauge plate, the extender gauge plate also comprising an upper surface against which sheet material being bent within the sheet bending brake will be supported.

3. The kit according to claim 2 wherein the extender plate is one of a plurality of extender plates, each extender plate at least one a different length and having at least a mark of a plurality of marks upon its upper surface, each mark of the plurality of marks relating to the position of a bend to be induced by the sheet bending brake relative to an edge of the sheet of material within which the bend will be made.

4. The kit according to claim 2 further comprising;

a first predetermined portion of a fifth mounting means disposed at a second distal end of the extender gauge plate for demountably attaching another extender gauge plate to the extender gauge plate, wherein the other extender gauge plate is cross-sectionally dimensioned for compatibility with both the gauge plate and extender gauge plate to allow the stop to move between extender gauge plate and another extender gauge plate, the extender gauge plate also comprising an upper surface against which sheet material being bent within the sheet bending brake will be supported.

5. The kit according to claim 1 wherein the upper surface of the gauge plate comprises at least a mark of a plurality of marks relating to the position of a bend to be induced by the sheet bending brake relative to an edge of the sheet of material within which the bend will be made.

6. The kit according to claim 1 wherein the first mounting means is a magnet.

7. A kit comprising:

a gauge plate comprising a first mounting means and an upper surface against which sheet material being bent within the sheet bending brake will be supported, the first mounting means supporting mounting of the gauge plate to a bending bar of a sheet bending brake; and a stop dimensioned to slide along the gauge plate and comprising a second mounting means to reversibly lock the stop to the gauge plate.

8. The kit according to claim 7 further comprising;

a first predetermined portion of a third mounting means disposed at a second distal end of the gauge plate for demountably attaching an extender gauge plate to the gauge plate;

the extender gauge plate cross-sectionally dimensioned for compatibility with the gauge plate to allow the stop to move between gauge plate and extender gauge plate, the extender gauge plate also comprising an upper surface against which sheet material being bent within the sheet bending brake will be supported.

9. The kit according to claim 8 wherein the extender plate is one of a plurality of extender plates, each extender plate at least one a different length and having at least a mark of a plurality of marks upon its upper surface, each mark of the plurality of marks relating to the position of a bend to be induced by the sheet bending brake relative to an edge of the sheet of material within which the bend will be made.

10. The kit according to claim 8 further comprising;

a first predetermined portion of a fourth mounting means disposed at a second distal end of the extender gauge plate for demountably attaching another extender gauge plate to the extender gauge plate, wherein the other extender gauge plate is cross-sectionally dimensioned for compatibility with both the gauge plate and extender gauge plate to allow the stop to move between extender gauge plate and another extender gauge plate, the extender gauge plate also comprising an upper surface against which sheet material being bent within the sheet bending brake will be supported.

11. The kit according to claim 7 wherein the upper surface of the gauge plate comprises at least a mark of a plurality of marks relating to the position of a bend to be induced by the sheet bending brake relative to an edge of the sheet of material within which the bend will be made.

12. The kit according to claim 7 wherein the bending bar movable between a first position and a second position wherein an angle between the first position and the second position is 90° resulting in a 90° bend being induced within sheet material.

* * * * *